US005682822A

United States Patent [19]

Sunderman et al.

[11] Patent Number: 5,682,822

[45] Date of Patent: Nov. 4, 1997

[54] RAILWAY CAR SIDE BEARING

[76] Inventors: John R. Sunderman, 3503 Jones St., #301, Omaha, Nebr. 68105; Dale E. Monsell, 120 S. 44th St., Omaha, Nebr. 68131; Robert E. Owen, 1400 S. 84th St., Omaha, Nebr. 68124

[21] Appl. No.: 680,061

[22] Filed: Jul. 15, 1996

[51] Int. Cl.[6] ..... B61F 5/14

[52] U.S. Cl. ..... 105/199.3; 384/423

[58] Field of Search ..... 105/199.3; 384/420, 384/423

[56] References Cited

U.S. PATENT DOCUMENTS

| | | | |
|---|---|---|---|
| 308,776 | 11/1884 | Lane . | |
| 516,935 | 3/1894 | Kling . | |
| 690,330 | 12/1901 | Timmis . | |
| 740,605 | 10/1903 | Summers . | |
| 1,144,392 | 6/1915 | Summers . | |
| 1,408,371 | 2/1922 | Linton . | |
| 1,921,894 | 8/1933 | Symington . | |
| 2,111,428 | 3/1938 | Kjolseth | 105/175 |
| 2,227,140 | 12/1940 | Kjolseth . | |
| 2,407,875 | 9/1946 | Geiger . | |
| 2,422,638 | 6/1947 | Tucker | 105/197 |
| 2,652,244 | 9/1953 | Christenson | 267/9 |
| 2,676,550 | 4/1954 | Burdick | 105/199 |
| 2,696,176 | 12/1954 | Dath | 105/197 |
| 3,376,831 | 4/1968 | Eaton et al. | 105/199 |
| 3,376,958 | 4/1968 | Carr | 188/97 |
| 3,443,528 | 5/1969 | Lipsius et al. | 105/171 |
| 3,670,660 | 6/1972 | Weber et al. | 105/171 |
| 3,712,691 | 1/1973 | Cope | 105/199.3 |
| 3,731,638 | 5/1973 | Tack | 105/199.1 |
| 3,865,045 | 2/1975 | Jones, Jr. | 105/199.3 |
| 3,981,548 | 9/1976 | MacDonnell et al. | 105/199.3 |
| 4,080,016 | 3/1978 | Wiebe | 105/199.3 |
| 4,955,293 | 9/1990 | Kramer et al. | 105/199.3 |
| 5,386,783 | 2/1995 | Rhen et al. | 105/199.3 |

FOREIGN PATENT DOCUMENTS

| | | | |
|---|---|---|---|
| 1382426 | 11/1964 | France | 105/199.3 |

*Primary Examiner*—S. Joseph Morano

*Attorney, Agent, or Firm*—Zarley, McKee, Thomte Voorhees & Sease; Mark D. Frederiksen

[57] ABSTRACT

A railway car truck side bearing includes a housing mounted on the upper surface of a truck bolster with an engagement member biased upwardly from the housing into engagement with a depression formed in a wear plate attached to the bottom of a car body. A carriage is affixed to the bottom of the top plate and supports two stacks of disk springs under an engagement member support member to bias the support member and the engagement member upwardly into the top plate aperture. A pair of elastomeric blocks are located on opposite sides of the carriage, between the top plate and the housing bottom, within the housing, to act as shock absorbers for the top plate.

23 Claims, 3 Drawing Sheets

RAILWAY CAR SIDE BEARING

TECHNICAL FIELD

The present invention relates generally to stabilizing and yaw control devices for the trucks of railway cars, and more particularly for an improved side bearing for railway car bodies.

BACKGROUND OF THE INVENTION

Truck hunting causes the rolling wheels and axle assembly of a standard railroad freight car truck to move along a pair of rails in a generally sinusoidal path, causing the railway truck to oscillate laterally and yaw cyclically with respect to the car body about a vertical axis passing through the truck bolster center plate. With controlled truck hunting, the amount of the cyclical lateral motion is relatively small and the wheel flanges will not contact the rails. However, at higher speeds, unstable truck hunting can develop if the frequency of the cyclical motion approaches resonance, wherein the wave pattern of the wheel and axle assembly has the same frequency as the natural roll, sway, and yaw frequencies of the car body. Violent lateral forces are created during uncontrolled truck hunting, which can cause rail damage, excess wear to the truck and car body, as well as heavy lateral impacts between the wheel flanges and rails.

Railway truck side bearings have been utilized in the prior art to provide support for a car body with respect to a truck, laterally outwardly of the truck center plate. Such side bearings are necessary to prevent the tendency of a car body to rock from side to side as a result of truck hunting as well as curves in the railroad track.

Typical roller side bearings in the prior art include rollers carried within a housing mounted on the railway truck bolster. The roller extended above the open top of the housing for rolling engagement with a wear plate on the bottom of the car body. In this way, the car body was supported laterally outwardly of the truck center plate on the bolster, while permitting the truck to rotate about a vertical centerline of the bolster center plate, to permit normal truck movement along the railroad track.

In an effort to improve upon the conventional side bearings, so as to increase truck hunting stability as well as car body lateral roll stability, various devices have been installed between the car body and truck bolster to replace or supplement the conventional roller side bearing. Such devices have taken the form of elastomeric blocks or other elements forming a constant contact bearing to modify rotational swiveling resistance characteristics of the truck as well as affecting the lateral roll motion of the car body.

As a result of prior art truck stabilizing devices, the truck swiveling resistance was usually characterized by a gradually increasing opposed force up to a point of relative sliding displacement between the support surfaces. As the truck continued to swivel, a substantially constant sliding frictional restraint was maintained up to the point of maximum truck swiveling. Because of the relative sliding displacement, the return truck motion was opposed by a frictional sliding resistance. Also, because of the reverse elastic deformation of the elastomeric block, some additional truck swiveling motion was required to restart the truck in a straight running position.

SUMMARY OF THE INVENTION

It is therefore a general object of the present invention to provide a novel and improved railway truck side bearing.

Another object is to provide a side bearing which creates a relatively high initial resistive force opposing truck swiveling, which rapidly decreases with increasing swiveling displacement.

A further object of the present invention is to provide a truck side bearing with desired swiveling resistant torque characteristics, but which is economical to manufacture and of simple mechanical design.

These and other objects of the present invention will be obvious to those of ordinary skill in the art.

The railway car truck side bearing of the present invention includes a housing mounted on the upper surface of a truck bolster with an engagement member biased upwardly from the housing into engagement with a depression formed in a wear plate attached to the bottom of a car body. A carriage is affixed to the bottom of the top plate and supports two stacks of disk springs under an engagement member support member to bias the support member and the engagement member upwardly into the top plate aperture. A pair of elastomeric blocks are located on opposite sides of the carriage, between the top plate and the housing bottom, within the housing, to act as shock absorbers for the top plate.

DESCRIPTION OF THE PREFERRED EMBODIMENT

Figure 1:
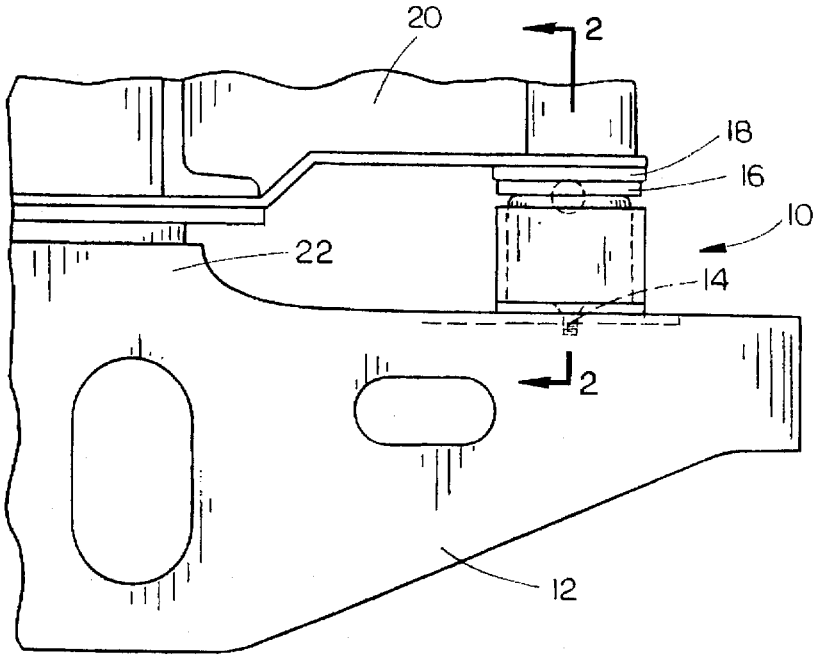
FIG. 1 is an end elevational view showing the side bearing of the present invention mounted between a railway truck and a car body.

Referring now to the drawings, in which the same or similar pads are identified with the same reference numeral and more particularly to FIG. 1, the side bearing assembly of the present invention is designated generally at 10 and is supported atop a bolster 12 of a railway truck and is secured thereto by threaded fastener 14. Side bearing assembly 10 includes a top plate 16 having an upper surface in frictional contact with a bottom surface of a wear plate 18 mounted on the bottom of rail car body 20. The rail car body 20 is supported by a center plate bearing portion 22 of bolster 12. Although this invention will be described with reference to a conventional truck bolster and center plate support system, it will be understood that the invention may also be utilized in other car body support applications such as intermodal cars or other car configurations, as well as alternative truck configurations such as single axle trucks. Because the following drawings will show side bearing assembly 10 utilized on a conventional three piece truck, other components not shown, but well known in the field, include spring groups mounted in a pair of side frames to support the opposed longitudinal ends of bolster 12, as well as journaled wheel sets which rests on railroad tracks to support each side frame of the truck.

Figure 2:
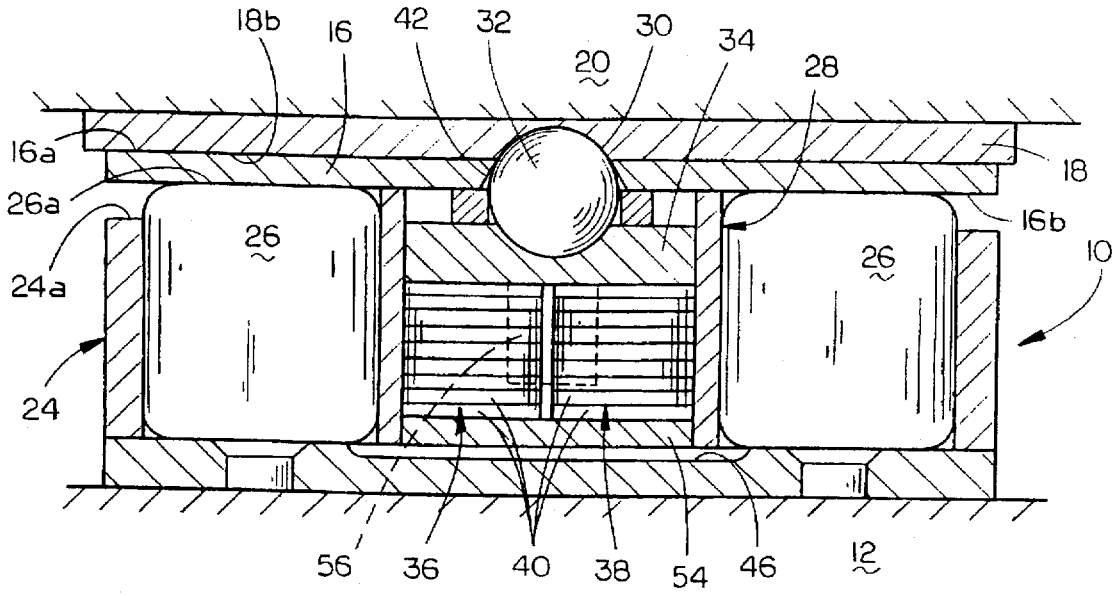
FIG. 2 is a sectional view taken at lines 2—2 in FIG. 1.

Referring now to FIG. 2, side bearing assembly 10 includes a base housing 24 having an open upper end which will receive a pair of elastomeric compressible blocks 26 as well as a ball assembly carriage 28, the carriage 28 depending from the bottom face **16*b* of top plate 16**. The upper face 16*a* of top plate 16 is in flush frictional engagement with the lower face 18*b* of wear plate 18.

A generally spherical dimple 30 is formed in the lower surface 18*b* of wear plate 18 and is formed to receive a ball 32 therein, to restrain slidable movement of the wear plate 18 relative to top plate 16. A ball support member 34 is slidably mounted within carriage 28 for vertical movement, and is biased upwardly by two stacks 36 and 38 of disk springs 40. An aperture 42 formed through top plate 16 allows an upper surface of ball 32 to project outwardly through top plate 16 as support member 34 biases the ball 32 upwardly.

Figure 3:
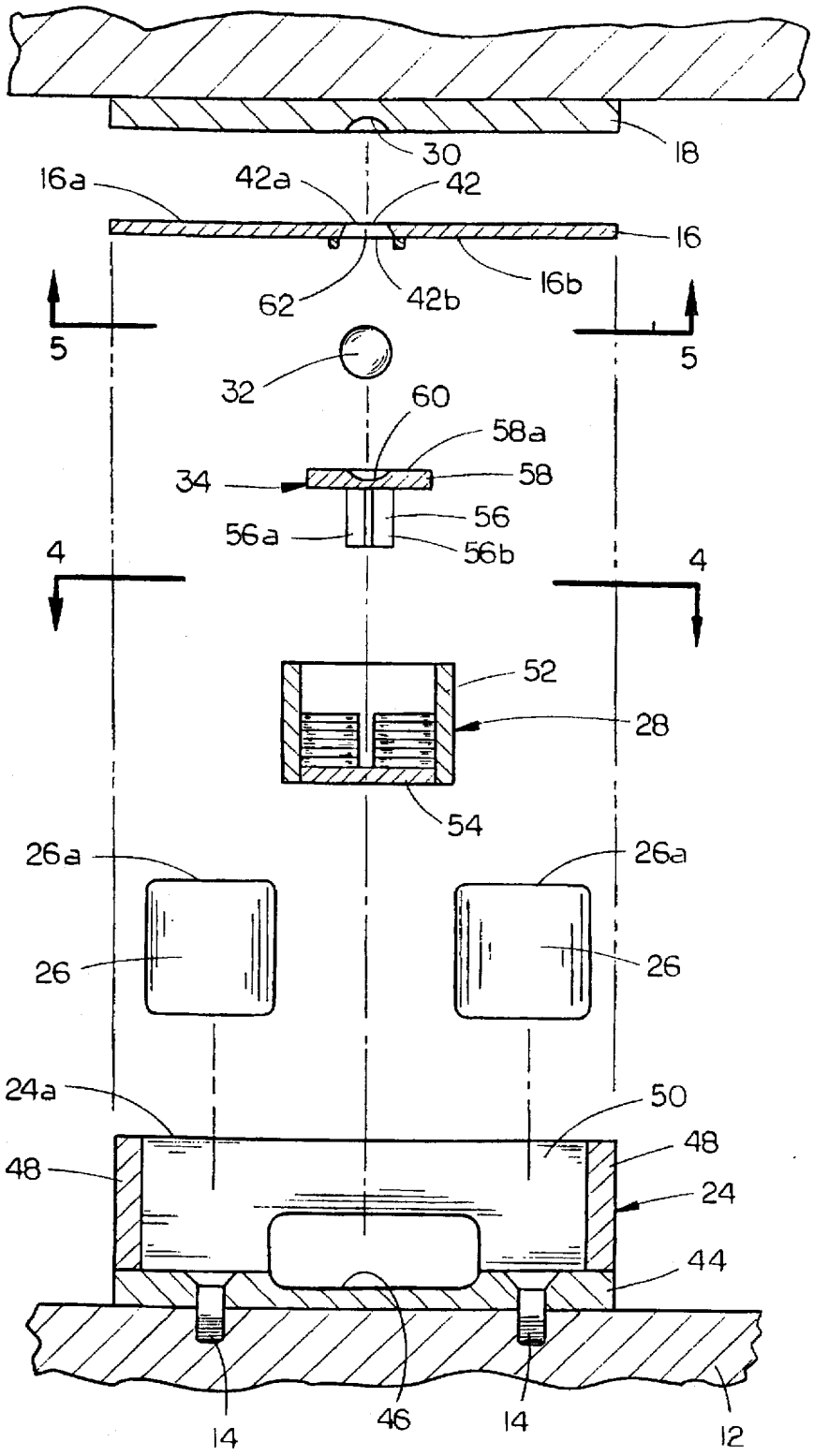
FIG. 3 is an exploded view of the sectional view of FIG. 2.

Referring now to FIG. 3, it can be seen that base housing 24 includes a base plate 44 mounted to bolster 12 with fasteners 14. A transversely extending channel 46 is formed in the upper surface of base plate 44 to permit a predetermined amount of downward movement of carriage 28 as elastomeric blocks 26 are compressed (see also FIG. 2). Vertically oriented dynamic forces from the roll and sway of the car body will cause such dynamic forces to occur.

A pair of vertical end plates 48 and opposing vertical side plates 50 complete base housing 24, to form a generally rectangular box having an open upper end.

Elastomeric blocks 26 have a height which is greater than the height of end plates 48 and side plates 50, such that a top surface 26*a* of blocks 26 projects upwardly beyond the upper edge 24*a* of base housing 24 (as shown in FIG. 2).

Figure 4:
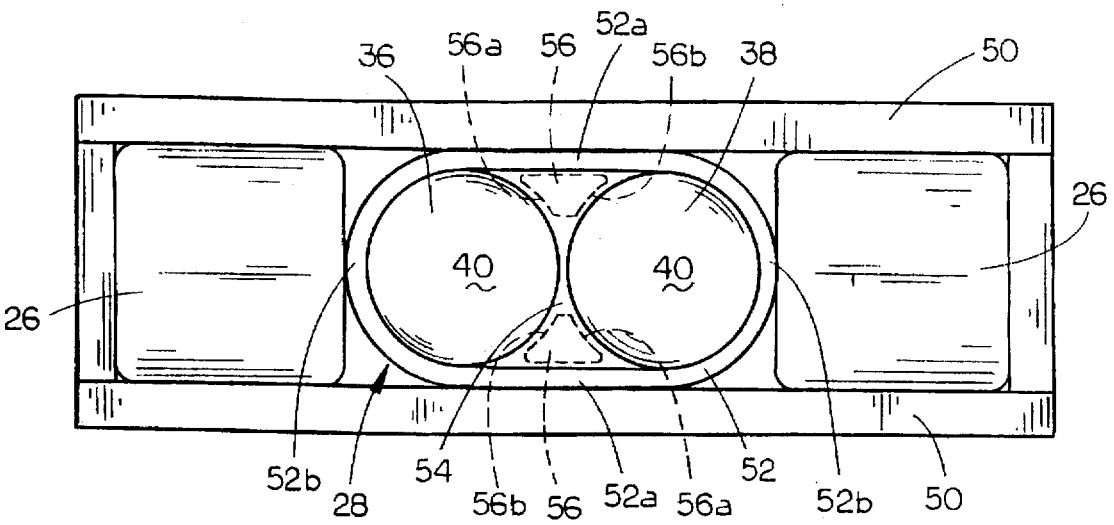
FIG. 4 is a plan elevational view taken at lines 4—4 in FIG. 3.
Figure 5:
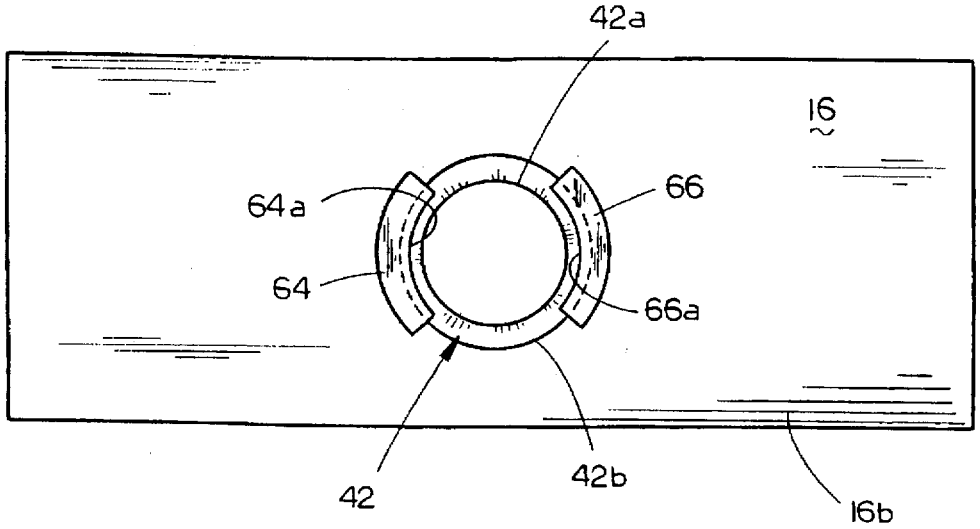
FIG. 5 is a plan view taken at lines 5—5 in FIG. 3.

Referring now to FIGS. 2–4, carriage 28 is generally oval in top plan view. Side wall 52 extends upwardly from an oval bottom plate 54, continuously around the entire perimeter thereof, to form carriage 28 with an open upper end. Carriage 28 has a width, as measured between longitudinal portions 52*a* of side wall 52 which fits closely between base side panels 50, to permit vertical slidable movement. The length of carriage 28, as measured between end portions 52*b* of perimeter side wall 52 is designed to fit snugly between elastomeric blocks 26. The oval shape of carriage 28 with semicircular end portions 52*b* permits two stacks 36 and 38 of disk springs 40 to be operably mounted therein. A pair of generally triangular guide legs 56 are shown in broken lines in FIG. 4, which extend downwardly into carriage 28 between stacks 36 and 38, from support plate 58 of ball support member 34 (see FIGS. 2 and 3). Two vertical surfaces 56*a* and 56*b* of guide legs 56 are curved to a radius matching the radius of disks 40, to further maintain disks 40 in their respective vertical stacks 36 and 38.

Referring once again to FIGS. 2 and 3, ball support member 34 includes a generally oval shaped support plate 58 having dimensions to be received within carriage 28, for vertical slidable movement therein. The upper surface 58*a* of support plate 58 has a spherical depression 60 formed therein of a radius matching the radius of ball 32, to receive and support ball 32 therein. As shown in FIG. 2 (in hidden lines) guide legs 56 have a length less than the height of disk stacks 36 and 38 when the disks are in a noncompressed state. As will be described in more detail hereinbelow, the distance between the lower end of guide legs 56 and the upper surface of carriage bottom plate 54 must be at least as great as the depth of dimple 30 in wear plate 18.

Although top plate 16 is shown separated from carriage 28, in operation, carriage 28 is affixed to the lower face 16*b* with ball 32, ball support assembly 34, and disk springs 40 therein. Aperture 42 has a tapered side wall 62, such that the diameter of aperture 42 at top plate upper face 16*a* has a smaller diameter than the diameter of aperture 42 at top plate lower face 16*b*In additional, the diameter 42*a* of aperture 42 is less than the diameter of ball 32, while the lower diameter 42*b* of aperture 42 is greater than the diameter of ball 32, such that ball 32 will project upwardly through aperture 42 beyond upper diameter 42*a*.

A pair of arcuate guide members 64 and 66 depend from the lower surface 16*b* of top plate 16 on diametric sides of aperture 42. Referably, guide members 64 and 66 have an inward side wall 64*a* and 66*a* respectively with a radius slightly greater than the radius of ball 32 and are positioned spaced apart slightly greater than the diameter of ball 32 and concentric with aperture diameters 42*a* and 42*b*. In this way, as ball 32 is biased downwardly into carriage 28, guide members 64 and 66 will maintain ball 32 in alignment with aperture 42, to return the ball to the position shown in FIG. 2 upon realignment of the dimple 30 with aperture 42.

In operation, the upwardly biased ball 32 engages dimple 30 in wear plate 18 to act as a detent mechanism in combination with the restraint provided by the friction between top plate 16 and wear plate 18. The friction produced between top plate 16 and wear plate 18 provides the primary restraint against swivel movement of the truck, while the detent mechanism supplements this frictional force. In this way, the detent mechanism acts as a centering device, and increases the initial resistance to truck hunting, while eliminating the initial resistance as the truck swivels on a curved railroad track or the like. The relative horizontal movement between the body mounted wear plate 18 and the truck mounted top plate 16 caused by the truck swiveling movement occurring as a rail car transits a curved railroad track will cause the ball 32 to retract into carriage 28, overcoming the bias of spring disks 40. As noted above, support member 34 must be capable of retracting downwardly into carriage 28 a distance sufficient to permit ball 32 to lower completely below the upper surface of top plate 16.

While the side bearing assembly 10 of the present invention has been shown with a spherical ball in engagement with a spherical dimple to act as a detent, it will be understood that other configurations and geometries are within the scope of the invention. For example, a roller could replace the ball, and the wear plate dimple and support plate depression replaced with cylindrical depressions to correspond with the shape of the roller. Similarly, more than one ball or roller could be utilized in the side bearing assembly, and the other equivalent biasing means are well known in the field.

Whereas the invention has been shown and described in connection with the preferred embodiment thereof, many modifications, substitutions and additions may be made which are within the intended broad scope of the appended claims.

I claim:

1. In combination:

a railway car having a car body with a bottom surface and at least one wheel truck with a bolster rotatably connected to the car body for rotation about a vertical center axis; and a side bearing operably mounted between the bolster and car body bottom surface for restraining rotational movement of the truck up to a predetermined level of torque and permitting rotational movement of the truck beyond the predetermined level of torque;

said side bearing including a detent mechanism having a first portion with a depression formed therein and a second portion with an engagement member and biasing means for biasing the engagement member into engagement with the depression in the first portion;

shock absorbing means independent of said engagement member biasing means, for absorbing and dissipating dynamic shocks directed generally vertically between the car body and bolster;

one of said side bearing first and second portions being mounted on the bolster for rotation of movement therewith and the other of said first and second portions being mounted on the car body; and said first portion depression and second portion engagement member having cooperable shapes of predetermined design for providing predetermined truck swiveling resistance force, and said biasing means providing a predetermined biasing force for effecting the truck swiveling resistance force.

2. The combination of claim 1, wherein said side bearing first portion includes a wear plate mounted on the car body, said wear plate having a contact surface and said depression formed in the wear plate contact surface.

3. The combination of claim 2, herein said wear plate is mounted on the car body bottom surface, and the side bearing second portion is mounted on an upper surface of the bolster, and wherein said engagement member is rotatably mounted in the side bearing second portion for rotation about an axis extending generally radially from the truck bolster rotational axis.

4. The combination of claim 1, wherein said biasing means is operably mounted in the side bearing second portion to bias the engagement member upwardly generally orthogonal to the engagement member rotational axis.

5. The combination of claim 4, wherein said side bearing second portion includes:

a base housing having a bottom, a pair of upwardly extending opposing side walls, and a pair of upwardly extending opposing end walls;

a top plate operably associated with the housing for vertical movement towards and away from the housing;

said top plate having an aperture therethrough of the size and shape to prevent movement of the engagement member therethrough, but permit an upper portion of the engagement member to project upwardly beyond an upper surface of the top plate;

said engagement member operably mounted between the housing and top plate with said biasing means located below the engagement member to bias the engagement member upwardly to project through the top plate aperture.

6. The combination of claim 5, wherein said shock absorbing means is operably mounted between the top plate and housing, said shock absorbing means supporting the top plates spaced above and out of contact with the housing when in an unbiased state, and biasing against downward movement of the top plate when in a biased state.

7. The combination of claim 6, wherein said shock absorbing means includes an elastomeric block of resilient compressible material.

8. The combination of claim 6, wherein said top plate includes a carriage depending therefrom and supporting the engagement member and the engagement member biasing means.

9. The combination of claim 5, wherein said top plate includes a carriage depending therefrom and supporting the engagement member and the engagement member biasing means.

10. The combination of claim 9, further comprising an engagement member support member interposed between the engagement member and the engagement member biasing means, said support member having an upper surface with a depression therein, the depression having a shape and size to cooperably receive a lower portion of the engagement member therein.

11. The combination of claim 5, further comprising an engagement member support member interposed between the engagement member and the engagement member biasing means, said support member having an upper surface with a depression therein, the depression having a shape and size to cooperably receive a lower portion of the engagement member therein.

12. A railway truck side bearing with truck swivel restraint, for a railway car, the car including a car body with a wear plate mounted on a bottom surface thereof, the wear plate having a contact surface with a depression formed therein, and a wheel truck with a bolster rotatably connected to the car body for rotation about a vertical center axis, said side bearing including:

a housing having a bottom, opposing upwardly extending side walls, and opposing upwardly extending end walls;

a top plate operably associated with the housing for vertical movement towards and away from the housing;

an engagement member operably mounted between the top plate and housing;

said top plate having an aperture formed therethrough of a size and shape to prevent movement of the engagement member therethrough, but permit an upper portion of the engagement member to project upwardly beyond an upper surface of the top plate; and biasing means positioned below the engagement member to bias the engagement member upwardly to project through the top plate aperture.

13. The side bearing of claim 12, wherein said engagement member is rotatably mounted for rotation about an axis substantially parallel to an upper surface of the top plate.

14. The side bearing of claim 13, wherein said side bearing further includes shock absorbing means independent of the biasing means, located between the top plate and housing, for absorbing and dissipating dynamic shocks directed generally vertically downwardly on the top plate.

15. The side bearing of claim 14, wherein said shock absorbing means is operably mounted between the top plate and housing, said shock absorbing means supporting the top plates spaced above and out of contact with the housing when in an unbiased state, and biasing against downward movement of the top plate when in a biased state.

16. The side bearing of claim 15, wherein said shock absorbing means includes an elastomeric block of resilient compressible material.

17. The side bearing of claim 15, wherein said top plate includes a carriage depending therefrom and supporting the engagement member and the engagement member biasing means.

18. The side bearing of claim 15, further comprising an engagement member support member interposed between the engagement member and the engagement member biasing means, said support member having an upper surface with a depression therein, the depression having a shape and size to cooperably receive a lower portion of the engagement member therein.

19. The side bearing of claim 13, wherein said top plate includes a carriage depending therefrom and supporting the engagement member and the engagement member biasing means.

20. The side bearing of claim 15, further comprising an engagement member support member interposed between the engagement member and the engagement member biasing means, said support member having an upper surface with a depression therein, the depression having a shape and size to cooperably receive a lower portion of the engagement member therein.

21. The side bearing of claim 12, wherein said side bearing further includes shock absorbing means independent of the biasing means, located between the top plate and housing, for absorbing and dissipating dynamic shocks directed generally vertically downwardly on the top plate.

22. In combination with a railway car comprising a car body and at least one wheel truck bolster rotatably connected to the car body for rotation about a yaw axis, an improved side bearing comprising:

an upper load support surface carried by the car body;

a lower load support surface carried by the bolster;

a first biasing device reacting against (1) one of the car body and the bolster and (2) the respective load support surface to resist roll of the car body; and a detent mechanism tending to locate the bolster at a selected angular position about the yaw axis with respect to the car body; wherein the detent mechanism comprises:

a depression formed in one of the load support surfaces;

an engagement member carried by the other of the load support surfaces; and a second biasing device biasing the engagement member toward said one of the load support surfaces.

23. The combination of claim 22, wherein said other of the load support surfaces is resiliently supported on the first biasing device.

* * * * *